US005439121A

United States Patent [19]

Agostoni

[11] Patent Number: 5,439,121

[45] Date of Patent: Aug. 8, 1995

[54] LOWERABLE CLOTHES-HANGER SUPPORTING DEVICE FOR WARDROBES

[75] Inventor: Egidio Agostoni, Zola Predosa, Italy

[73] Assignee: AMBOS S.r.l., Bologna, Italy

[21] Appl. No.: 228,632

[22] Filed: Apr. 18, 1994

[30] Foreign Application Priority Data

May 11, 1993 [IT] Italy ..... B093A0209 U

[51] Int. Cl.[6] ..... A47F 5/00

[52] U.S. Cl. ..... 211/100; 211/171

[58] Field of Search ..... 211/123, 105.1, 171, 211/99, 100, 101

[56] References Cited

U.S. PATENT DOCUMENTS

| | | | |
|---|---|---|---|
| 2,480,515 | 8/1949 | Smith | 211/100 |
| 2,597,115 | 5/1952 | Lundstrum | 211/100 |
| 2,875,903 | 3/1959 | Shourds | 211/100 |
| 3,490,600 | 1/1970 | Reed et al. | 211/100 X |
| 4,109,794 | 8/1978 | Samuel et al. | 211/100 X |
| 4,114,764 | 9/1978 | Rich | 211/101 X |
| 4,126,231 | 11/1978 | Derwent-Wryde | 211/99 |

*Primary Examiner*—Robert W. Gibson, Jr.

*Attorney, Agent, or Firm*—Guido Modiano; Albert Josif

[57] ABSTRACT

The lowerable clothes-hanger supporting device for wardrobes comprises a plate fixable to a wardrobe side panel, and a disk-like element provided with an arm having an end connected to a rail for supporting clothes hangers. The disk-like element is mounted on the plate so that it can oscillate in a plane between two positions in which the rail is respectively raised and lowered. A first elastic member is placed around the disk-like element to return it to the position in which the rail is raised. A second elastic member is applied eccentrically with respect to the disk-like element, so as to apply thereon a moment in the same or opposite direction with respect to the moment applied by the first elastic member around the positions that respectively correspond to the lifting and lowering of the rail. An actuation rod is connected to the disk-like element for lowering and lifting the rail.

11 Claims, 5 Drawing Sheets

FIG.11
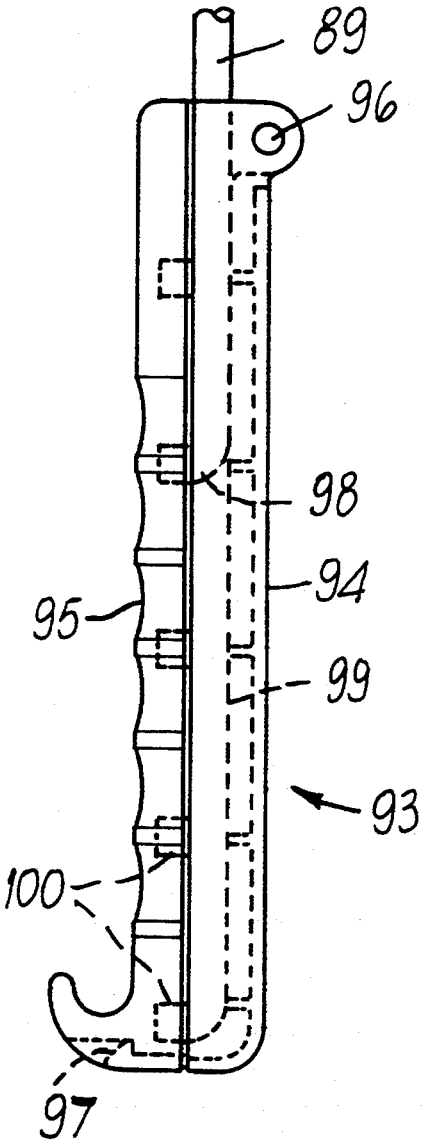
FIG.10
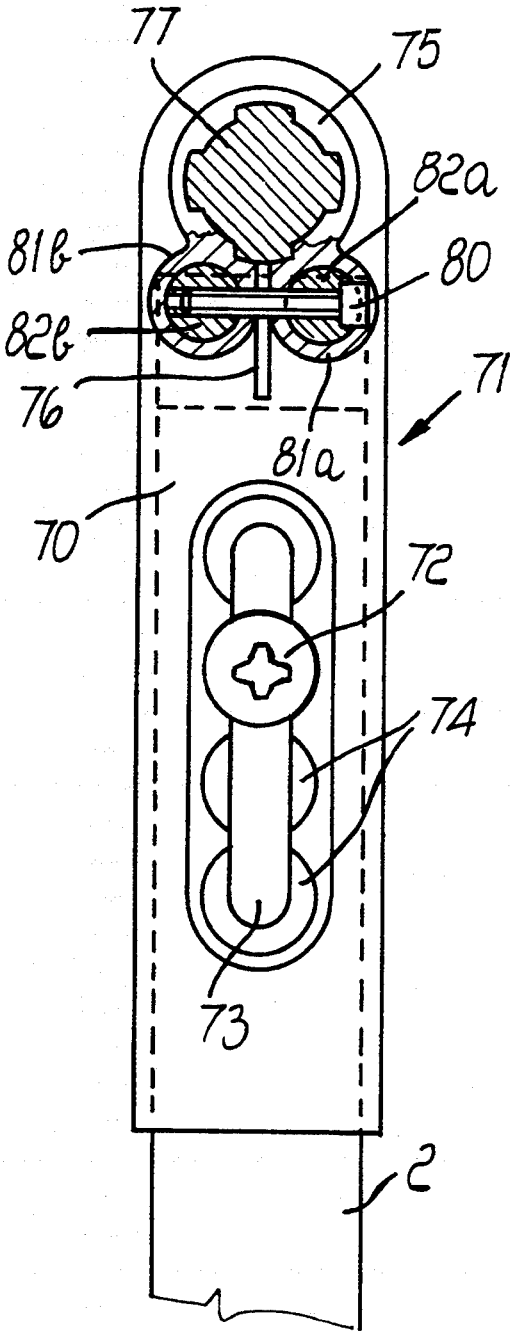
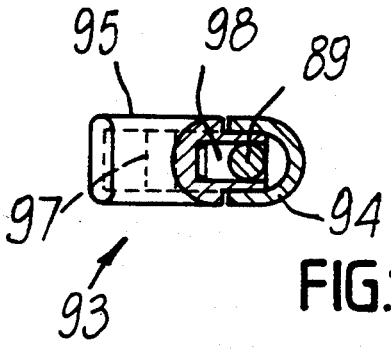
FIG.12

LOWERABLE CLOTHES-HANGER SUPPORTING DEVICE FOR WARDROBES

BACKGROUND OF THE INVENTION

The present invention relates to a lowerable clothes-hanger supporting device for wardrobes.

As it is known, wardrobes divided into two stacked compartments are currently in widespread use for clothes storage. Placement and removal of clothes hangers in and from the upper compartments are often rather troublesome: ladders and stools are in fact rarely immediately available, and use thereof is somewhat awkward; it is also awkward to use appropriate tools to engage the individual hanger and lift it into, or lower it out of, the upper compartment of the wardrobe.

The upper compartments of two-level wardrobes have accordingly been equipped with devices that allow to lower the rail supporting the clothes hangers.

Said devices have lever systems for articulating the rail to the side panels of the wardrobe; these lever systems cooperate with means that are supposed to facilitate the operations for the descent and rise of the rail. However, these means are not always designed so as to have, during the various operating steps, a favorable ratio between the force that is required and the resistance that is opposed.

Some devices already in use, however, have compact structures but are rather expensive; other known devices are instead relatively cheap, but, due to their multiple fully-exposed structural elements and to their paths, they are considerably bulky and can undesirably interfere with the user and with items placed in the wardrobes.

SUMMARY OF THE INVENTION

The aim of the present invention is to obviate the difficulties and drawbacks of existing lowerable clothes-hanger supporting devices for wardrobes by providing a device that, in all of its operating steps, optimizes the ratio between the forces and resistances involved, furthermore adapting to the load of clothes that bears on it.

Within the scope of this aim, an object of the device according to the present invention is to provide a compact structure that has a limited bulk, is quick and easy to assemble and adapt to wardrobes of various sizes, and has a relatively low cost.

With this aim and this object in view, there is provided, according to the present invention, a lowerable clothes-hanger supporting device for wardrobes, characterized in that it comprises: a plate for fixing it to a side panel of the wardrobe; a disk-like element that has an arm lying on a plane parallel to said plate and to said side panel, said arm having, at its end, a rail for supporting the clothes hangers, and being mounted on said plate so that it can oscillate in said plane between two positions in which the rail is respectively raised and lowered; a first elastic means located around said disk-like element to return it to the position in which the rail is raised; a second elastic means applied eccentrically with respect to the disk-like element so as to apply thereon a moment in the same or opposite direction with respect to the moment applied by said first elastic means around the positions that respectively correspond to the lifting and lowering of the rail; and an actuation rod for lowering and lifting said rail.

BRIEF DESCRIPTION OF THE DRAWINGS

Further details of the clothes-hanger supporting device according to the invention will become apparent from the following detailed description of a preferred but not exclusive embodiment thereof, illustrated only by way of non-limitative example in the accompanying drawings, wherein:

FIG. 10 is a front view of a head of said arm;

FIGS. 11 and 12 are respectively a side view and a horizontal sectional view of a handle of said actuation rod.

DESCRIPTION OF THE PREFERRED EMBODIMENTS

Figure 1:
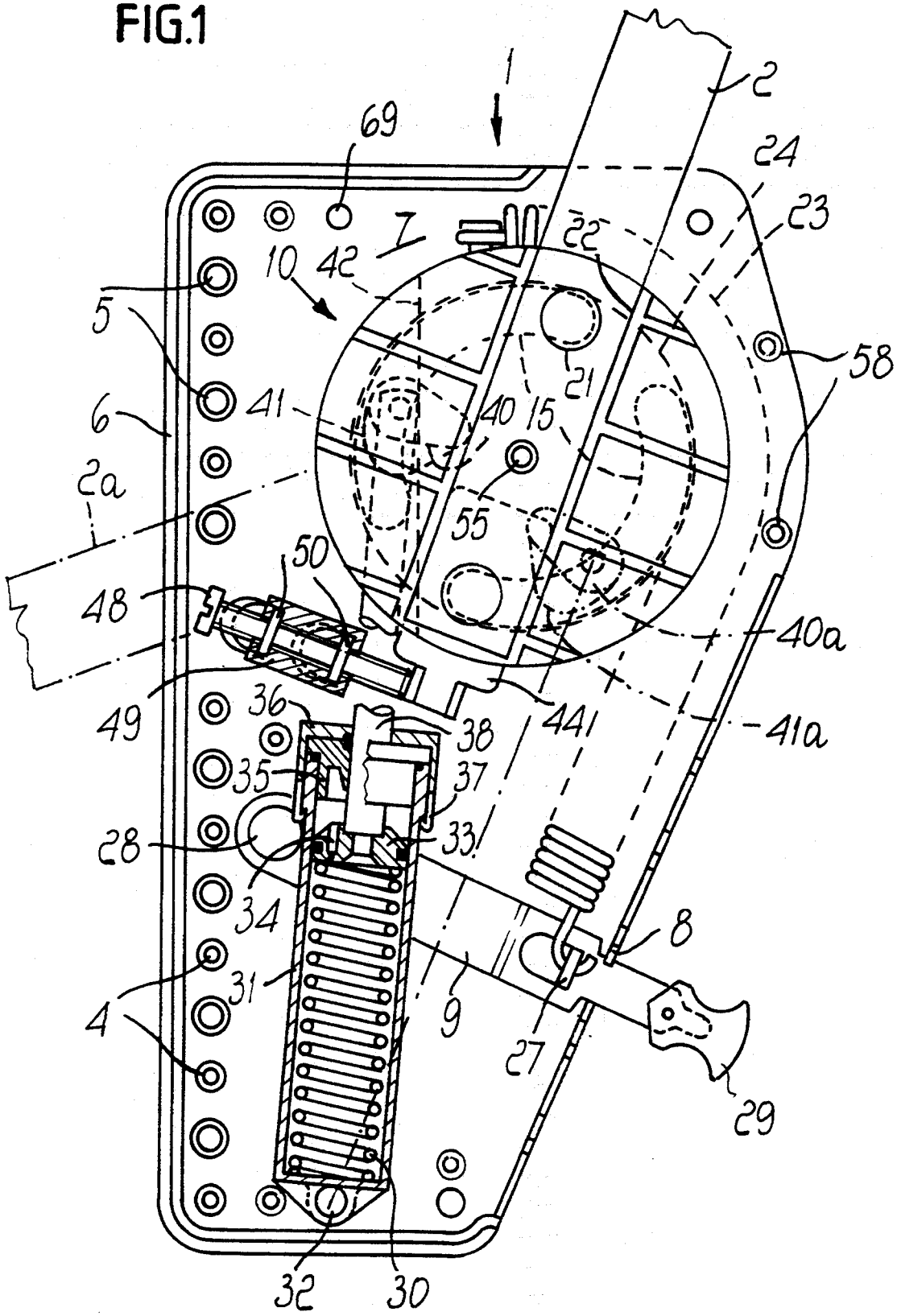
FIG. 1 is a partially sectional front view of a main part of the device according to the invention.

With particular reference to the above figures, the reference numeral 1 designates one of the two symmetrical plates for fixing the corresponding two main parts of the lowerable clothes-hanger supporting device to a respective side panel F of a wardrobe.

As will become apparent hereinafter, each one of the plates 1 oscillatably supports a respective arm 2; a rail 3, for supporting clothes hangers which are not shown, runs between the ends of the two arms 2 of two adjacent side panels F.

Usually, both arms 2 are substantially vertical and the rail 3 is raised. In FIG. 1, one arm 2 is shown in solid lines in this condition. When the arm is in the condition in which the rail 3 is lowered, it is instead shown in dot-and-dash lines and designated by the reference numeral *2a*.

Figure 2:
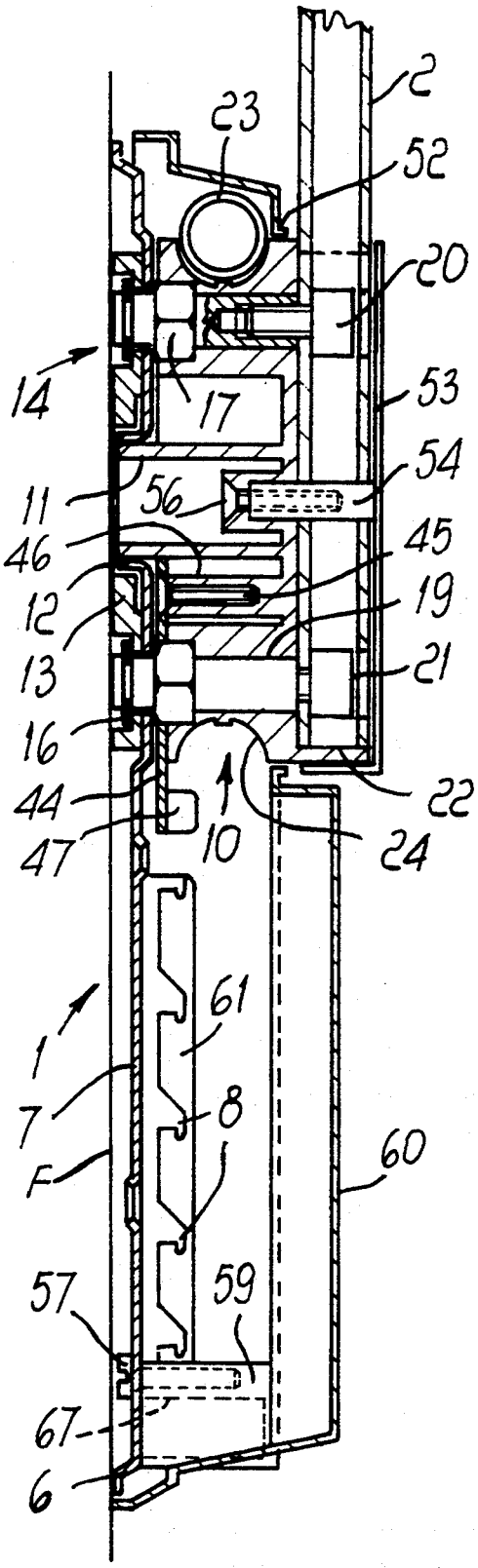
FIG. 2 is substantially a vertical sectional view thereof.
Figure 3:
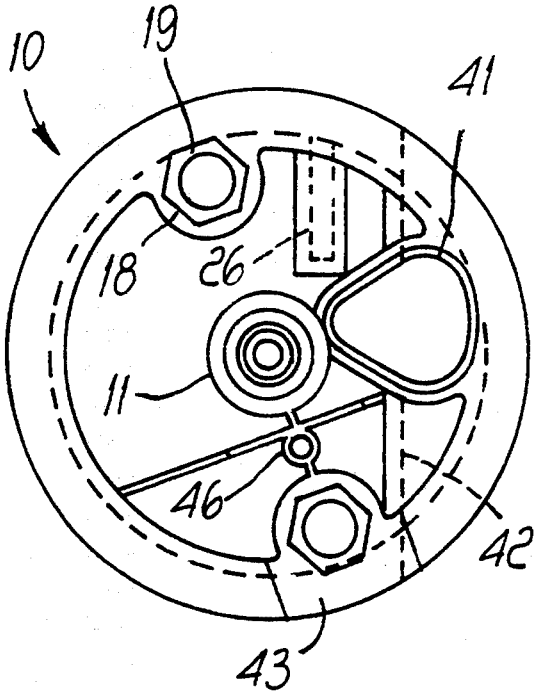
FIG. 3 is a rear view of said disk-like element.
Figure 4:
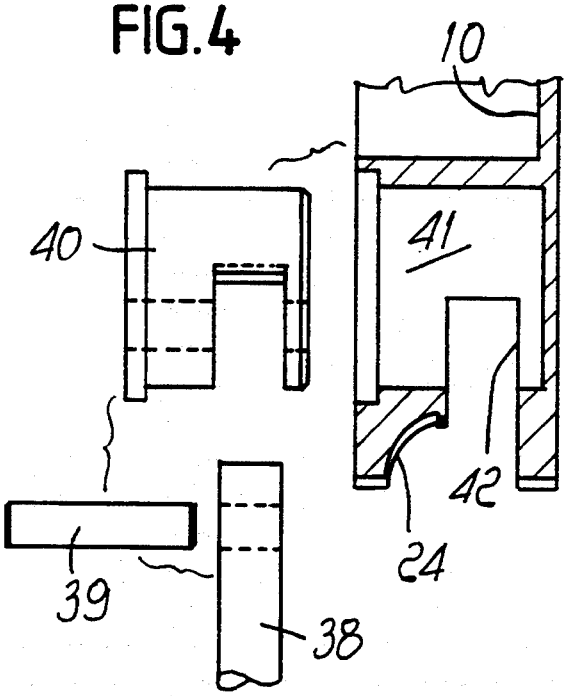
FIG. 4 is an exploded detail view of a linkage of the device.

The plate 1 (FIGS. 1 and 2) is formed from metal plates by blanking, pressing and bending and has a set of holes 4 and a set of holes 5 along its front edge, i.e. along the edge directed toward the front of the wardrobe. The holes 4 (like the holes 5) have the same even spacing as those normally formed in the side panel of the wardrobe and are thus suitable for the insertion of screws (not shown) for fixing to said side panel: the holes 5 have a larger diameter than the holes 4 and are thus suitable for fixing screws having a larger diameter.

The plate 1 is fixed against the side panel of the wardrobe by means of screws at the lowered edge 6 that lies on the front side and on the two adjacent sides of the plate. Said plate thus generally forms a surface 7 which is slightly spaced from the surface of the side panel; a folded region rises from the surface 7 along a portion of the rear side of the plate, and a series of engagement elements 8 for the lever 9 is formed in said folded region; the lever 9 will be described hereinafter and has been omitted in FIG. 2.

A disk-like element 10, in practice made of plastics, is oscillatably mounted on the plate 1 and lies on a plane that is parallel to the surface 7. On the rear, the element 10 in fact forms a tubular tang 11 which is inserted in a large hole of the plate 1 and is centered in the border 12 of said hole, which is folded backward. A flat ring 13 is located around the border 12 and behind the plate 1 and is crossed, in two diametrically opposite positions, by the rear end of respective pivot elements 14, each of which also passes through an associated slot 15 formed in the plate 1 concentrically to the border 12. Said end of each element 14 is engaged by an elastic ring 16 accommodated in a corresponding seat formed on the rear of the ring 13. In front of the plate 1, each pivot element 14 forms a prism-like expansion 17 that couples in a complementarily shaped seat 18 formed on the rear of the disk 10. A hole 19 is present in each seat 18 and ends on the front of the disk 10; the other end of the corresponding pivot element 14 is inserted in said hole and is internally threaded so as to engage a screw 20. The two screws 20 secure the end of the arm 2, which lies opposite to the rail 3, to the disk 10; the arm 2 is tubular, is made of metal, and has a rectangular cross-section; the screws 20, which enter it through the holes 21 of one of its walls, secure its opposite wall to the disk 10. Said end of the arm 2 is inserted in a seat 22 which is formed on the front of the disk 10 and lies substantially diametrically to it.

In order to return the disk 10 to the position in which the rail 3 is raised, a first elastic means is placed around said disk. Said means is constituted by a helical spring 23 elongated along an axis which winds partially around the disk 10. Correspondingly, the disk 10, below the seat 22, forms a groove 24 in its peripheral region; the spring 23 has limited contact with said groove. One end of the spring 23, which is of the traction type, is fixed to the disk 10 by means of a screw 25 which is screwed in the seat 26 that lies substantially radially with respect to the disk. The other end of the spring 23 is a portion substantially tangent to the disk 10 and engages a tab 27 which is formed by blanking and bending in the plate-metal lever 9. The flat lever 9 is pivoted, at 28, to the plate 1 and lies substantially at right angles to said tangent portion of the spring 23, beyond the rear side of the plate that has the elements 8; depending on the element 8 with which the lever is engaged, a different tension is applied to the spring 23 to adjust the element proportionately to the load of clothes on the rail 3. A covering 29 is applied to the end of the lever 9 that protrudes to the rear from the plate 1.

A second resilient means is applied eccentrically to the disk 10 and is provided with damping means. Said means comprises a helical compression spring 30 that is located in the lower chamber of a cylinder 31; the cylinder is filled with an emulsion of air and grease and is pivoted to the plate 1 at 32, proximate to the lower edge thereof. The spring 30 is interposed between the bottom of the cylinder and a piston 33 that can slide in said cylinder and is crossed by a small hole 34. The upper chamber of the cylinder 31 is closed hermetically by a plug 35 which is retained on the cylinder by a sort of cap 36. The rim of said cap in fact forms a series of pawl-like parts 37 which are distributed with a uniform angular spacing and engage a complementarily shaped step formed on the outside of the cylinder 31. In practice, the parts 31, 33, 35 and 36 are made of plastics.

One end of a stem 38 is fixed to the piston 33 and passes hermetically through the plug 35 and the cap 36. The other end of the stem is articulated, by means of the pivot 39, to a linkage 40 which is accommodated in a deep lobate seat 41 formed in the rear part of the disk 10; said seat 41 provides the articulation of the linkage to the disk 10 and limits the angular strokes of said linkage with respect to said disk. The seat 41 and the groove 24 of the disk 10 are crossed by a cutout 42 that accommodates the relative movements of the stem 38 and of the disk 10.

A slight recess 43 is formed on the rear of the disk 10 around the hole 19, which is directed downward in normal conditions (when the rail 3 is raised). A small plate 44 is inserted in said recess, and a hole of said small plate is shaped complementarily to the expansion 17 of the associated pivot 14; the screw 45 engages the other hole of the small plate and, by screwing into the disk 10 at 46, locks said small plate to said disk. As regards the position of the arm 2 in which the rail 3 is raised, a tab 47 of the small plate 44 has an abutment adjustable by means of a screw 48 that screws in a plastic block 49. Said block is fitted on two tabs 50 which are formed in the plate 1 by blanking and bending. Feet-like parts of the block 49 are inserted in the empty spaces of the plate 1 left by the two tabs; it is said screw 48, by passing through the tabs 50, that retains the block on said tabs. By means of the screw 48 it is therefore possible to adjust the raised position of the rail 3 according to the depth of the wardrobe.

Figure 6:
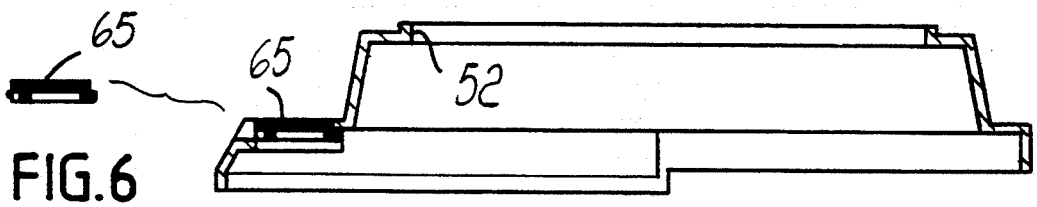
FIG. 6 is a sectional view of said case, taken along the plane VI—VI of FIG. 5.
Figure 5:
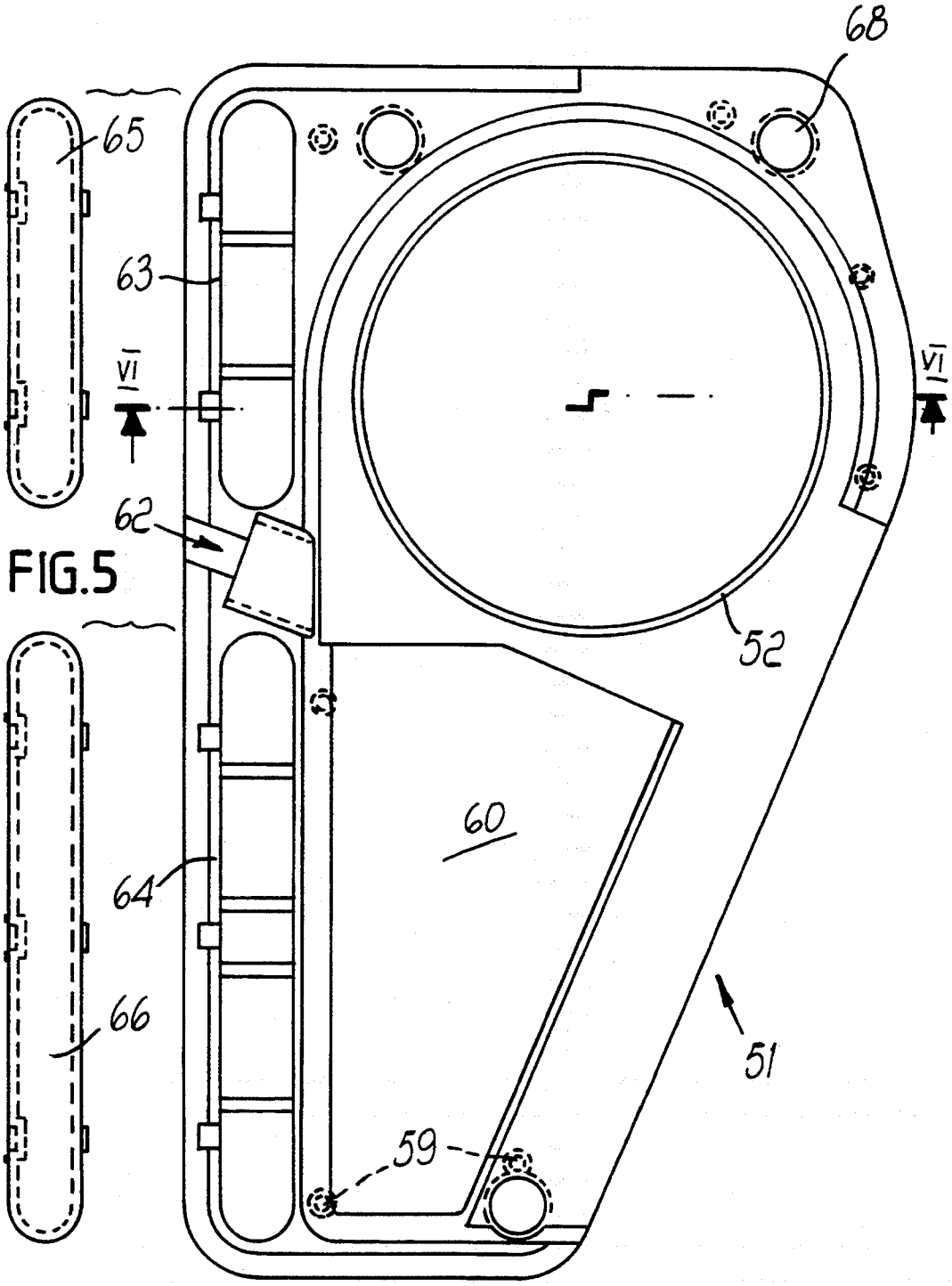
FIG. 5 is a front view, with some elements shown in exploded view, of a case that covers said main part and is removed in FIG. 1.

A case 51 covers the plate 1 except for the disk 10, which partially protrudes from the large hole 52 of said case. This part of the disk and the corresponding end of the arm 2 are in any case covered by a sort of cap 53, the tang 54 and 55 of which passes through said arm 2; said cap is locked to the disk 10 by a screw 56 which is inserted from the rear of the disk and screws into the tang 54. Screws 57 are inserted from the rear in the holes 58 of the plate 1 and screw into stub-like parts 59, which are formed internally by the case 51, so as to lock said case to the plate 1. The case covers the spring 23, most of the lever 9, and the cylinder 31, and forms the expansion 60 at the region covered by its angular strokes. The case has an opening 61 to allow the lever 9 to protrude and has an opening 62 for access to the adjustment screw 48. The case furthermore has, along its front edge and separate from the access opening 62, two slots 63 and 64 for accessing the series of holes 4 and 5; said slots are normally closed by the snap-on caps 65 and 66 (said caps are shown in exploded view in FIG. 5; in FIG. 6, the cap 65 is both exploded and inserted). The case furthermore has blind holes which are closed at the top by snap-on plugs 68. Holes 69 of the plate 1 can be accessed from the blind holes 67; if standard holes that match the holes 4 and 5 are not available in the side panel of the wardrobe, screws for fixing said plate to said side panel can be inserted in said holes 69.

Figures 7, 8, 9:
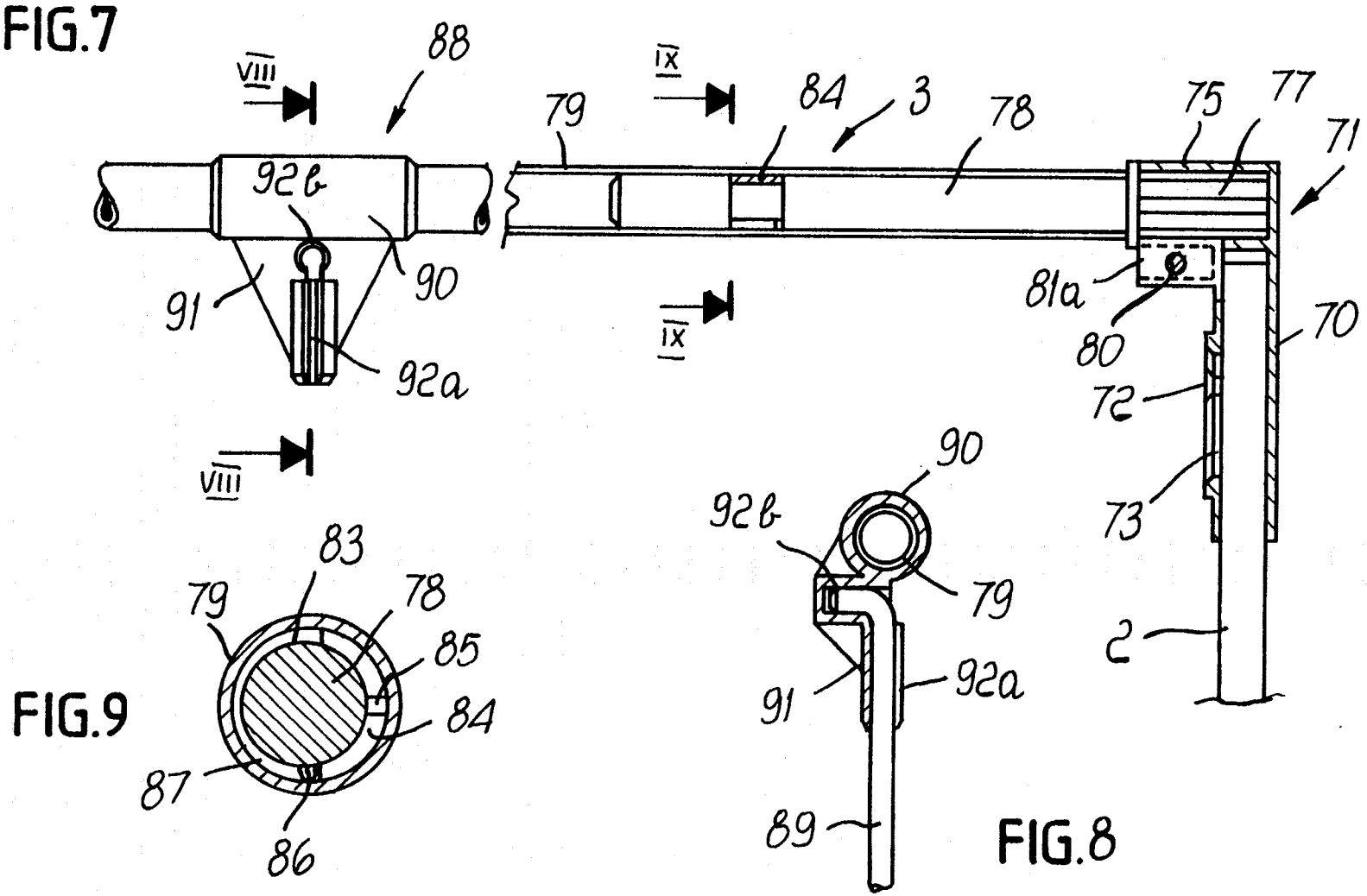
FIG. 7 is a partially sectional front view of said rail.
FIGS. 8 and 9 are sectional views of FIG. 7, taken respectively along the planes VIII—VIII and IX—IX.

A sleeve 70 is fitted on the end of the arm 2 which is opposite to the disk 10; said sleeve is formed by a head 71 made of plastics. The sleeve can be adjusted along said end of the arm 2, in which the screw 72 for locking one to the other is screwed: the sleeve has a slot 73 that forms a set of seats 74 for the head of the screw 72. The head 71 furthermore forms a sort of elastic ring 75 which is divided longitudinally in two by a slot 76 and internally toothed for the side-fitting coupling of the tang 77 of a stem 78. The stem 78 is inserted in the corresponding end portion of a tubular element 79 which forms, together with a pair of stems 78, a rail 3. The elastic ring 75 is secured against the tang 77 by virtue of the screw 80: at the two sides of the slot 76, the ring 75 in fact forms respective small tubes 81*a*, 81*b* accommodating respective small metal cylinders 82*a*, 82*b*; the screw 80, after passing through the tube 81*a* and the cylinder 82*a*, screws into the cylinder 82*b*. Therefore the length of the rail can be adjusted by means of the stems 78. In order to lock the tubular element 79 to the stems 78, said stems have an eccentric groove 83 in which the ring 84 is rotatably mounted; due to its elasticity, the ring 84 is longitudinally divided in two by the slot 85. Rotation of the ring 84 with respect to the stem 78 is limited by the abutment of a tooth 86, formed by the stem inside the groove 83, against the end of a slit 87 that runs practically along half of the circumference at the edge of the ring 84 (see FIGS. 7 and 9).

A coupling 88 for an actuation rod 89 is rotatably mounted on the tubular element 79 and has a sleeve 90 that forms, in a downward region, a flap 91 that has a front seat 92*a*–92*b* for the snap-together engagement of the upper end portion of the rod 89.

In its downward region, the rod 89 is provided with a vertically adjustable sleeve 93 which is constituted by two vertical casings 94 and 95. In an upward region, at 96, the two casings are mutually pivoted; they are suitable to be closed by snap-together action against each other by means of the hook 97 which is formed in a downward region by the casing 94. The lower portion of the rod 89 ends with the bend 98 and is accommodated and secured in the channel 99 which is formed inside the casing 95 and closed by the casing 94, whereas its bend is accommodated at various heights in one of the seats 100 formed by said casing 95.

Operation of the device is therefore as follows.

In normal conditions, the rail 3 is raised and substantially the two associated springs 23 keep the tabs 47 of the two arms 2 in forced abutment against the respective screws 48.

Assume that the rail 3 is to be lowered and the arm 2 must thus perform an angular stroke down to 2*a*; this stroke is shown to be counterclockwise in FIG. 1.

In order to start the descent, it is necessary to grip the handle 93 and pull the actuation rod 89 downward. The tension of the spring 23 thus gradually increases and tends to return the arm 2 so that it rests against the screw 48. However, the gradual increase in the moment applied to the disk 10 by the spring 23 is matched by the gradual increase of the opposite moment, which is produced by the clothes supported by the rail 3 and soon becomes predominant.

In any case, the descent of the rail is not sudden. Indeed, during most of the descent (as shown by the left portion of FIG. 1), the side of the seat 41 which is directed toward the screw 25 moves the linkage 40 so that it follows the counterclockwise stroke of the disk 10. In this manner, the piston 33 is lowered and the spring 30 is gradually compressed. Said spring, by means of the stem and the linkage, subjects the disk to a moment which has the same orientation as the one produced by the spring 23 but gradually decreases until it becomes nil when the stem 38 aligns with the linkage and with the center of the disk 10. On the other hand, the transfer of the air and grease emulsion from the lower chamber to the upper chamber of the cylinder 31 is hindered by the small hole 34.

Once this alignment condition has been passed, it is the spring 30 that tends to stretch again, moving the linkage against the other side of the seat 41 (see the dot-and-dash references in the right portion of FIG. 1: linkage 40*a* and seat 41*a*), and generating a moment that has the same orientation as the one produced by the clothes that weigh on the rail 3. When the pivots 14 reach the end of the slots 15 which is located downstream of the stroke in the counterclockwise rotation of the disk 10, said disk stops correspondingly at the lowermost position of the rail 3; in this condition, in which the rail is loaded with, and/or unloaded of, its clothes, the disk 10 is sort of supported in position by the system constituted by the spring 30, the stem 38, the linkage 40 and the seat 41. The opposite occurs when, by acting initially upward on the actuation rod 89, the rail 3 is returned to its raised position. In this case, too, said system 30-38-40-41 acts differently, depending on whether it is on one side or on the other with respect to the above-specified alignment condition, but it always acts in the manner that most favors the correct and easy use of the device.

The invention thus conceived is susceptible to numerous modifications and variations, all of which are within the scope claimed hereinafter.

In the practical execution of the invention, the materials employed, as well as the shapes and dimensions, may be any according to the requirements.

What is claimed is:

1. Lowerable clothes-hanger supporting device for wardrobes, comprising a plate for fixing the device to a side panel of the wardrobe; a disk-like element having an arm that lies on a plane parallel to said plate and to said side panel, said arm having at its end a rail for supporting clothes hangers, and being mounted on said plate so that it can oscillate in said plane between two positions in which the rail is respectively raised and lowered; a first elastic means, placed around said disk-like element to return it to the position in which the rail is raised; a second elastic means, applied eccentrically with respect to the disk-like element so as to apply thereon a moment in the same or opposite direction with respect to the moment applied by said first elastic means around the positions that respectively correspond to the lifting and lowering of the rail; and an actuation rod for lowering and lifting said rail.

2. Device according to claim 1, wherein said first elastic means is constituted by a helical spring elongated along an axis that winds partially around said disk-like element, which is correspondingly provided with a peripheral groove.

3. Device according to claim 2, wherein one end of said helical spring is fixed to said disk-like element, whereas the second end is adjustably engaged with said plate so as to adjust the tension applied to said spring according to the load of clothes.

4. Device according to claim 3, wherein said second end of the helical spring, which corresponds to a portion thereof which is substantially tangent to said disk-like element, is connected to a lever which is pivoted to said plate, substantially at right angles to said portion, and can thus be locked to said plate at a series of engagement elements formed by said plate.

5. Device according to claim 1, wherein said second elastic means has damping means.

6. Device according to claim 5, wherein said second elastic means comprises: a cylinder which is filled with an emulsion of air and grease and is pivoted to said plate at one of its ends; a piston slideable in said cylinder and crossed by a small hole; a compression spring which is interposed between said piston and said end of the cylinder; a stem which is rigidly coupled to the piston and protrudes from the other end of the cylinder; a linkage which is articulated to the end of said stem and to said disk-like element; and elements which are formed by said disk-like element so as to delimit the angular strokes of said linkage.

7. Device according to claim 1, wherein said plate has an abutment for said arm that can be adjusted according to the position that corresponds to the lifting of said rail.

8. Device according to claim 1, wherein said plate has, along its edge directed toward the front of the wardrobe, a series of holes for the insertion of the screws for fixing to the side panel of the wardrobe, said holes having the same even spacing as those normally formed in said side panel.

9. Device according to claim 1, wherein said plate, said first elastic means and second elastic means are covered by a case, said case having an opening for access to the adjustable abutment and to said holes, a further opening for the protrusion of said lever, and a hole for accommodating said disk-like element.

10. Device according to claim 1, wherein said rail has an adjustable length, is retained at each end to a head which can be adjusted along the end of a respective said arm, and rotatably supports, at a central region, the coupling for said actuation rod, which is provided with a vertically adjustable handle at a downward region thereof.

11. Device according to claim 10, wherein the lower portion of said actuation rod ends with a bend and in that said handle is constituted by a pair of vertical casings which are suitable to be closed by snap-together action against each other and to secure said portion of the rod, offering a series of seats at various heights for said bend.

* * * * *